United States Patent [19]

Lamb et al.

[11] 4,107,798

[45] Aug. 22, 1978

[54] SELF-CONTAINED TOILET

[75] Inventors: Richard C. Lamb, Plantsville; Robert C. Iwans, Farmington, both of Conn.

[73] Assignee: Koehler-Dayton, Inc., New Britain, Conn.

[21] Appl. No.: 816,586

[22] Filed: Jul. 18, 1977

[51] Int. Cl.[2] ..... E03D 1/00

[52] U.S. Cl. ..... 4/321; 4/426; 220/204

[58] Field of Search ..... 4/10, 69 R, 72–74, 4/76–80, 83, 89, 92, 94, 96, 115, 300, 315, 317, 318, 319, 321, 323, 334, 426, 431, 434; 137/512; 220/203, 204

[56] References Cited

U.S. PATENT DOCUMENTS

| | | | |
|---|---|---|---|
| 3,501,778 | 3/1970 | Minniear et al. | 4/115 X |
| 3,673,614 | 7/1972 | Claunch | 4/77 X |
| 3,922,730 | 12/1975 | Kemper | 4/10 |
| 3,995,328 | 12/1976 | Carolan | 4/10 |

*Primary Examiner*—Richard E. Aegerter
*Assistant Examiner*—Frederick R. Schmidt
*Attorney, Agent, or Firm*—Spencer T. Smith

[57] ABSTRACT

A self-contained toilet comprising a collecting tank, means for rinsing the interior of the collecting tank including a rinsing manifold, a rinsing conduit, and a check valve operatively connecting the rinsing manifold and rinsing conduit, and means for preventing liquid contained within the rinsing manifold from being forced through the check valve by a pressure differential thereacross including a second check valve, and check valve conduit means communicating at one end with one end of the second check valve and communicating at the other end with the rinsing means at a location proximate the connection of the rinsing manifold and the first check valve.

2 Claims, 2 Drawing Figures

SELF-CONTAINED TOILET

Figure 1:
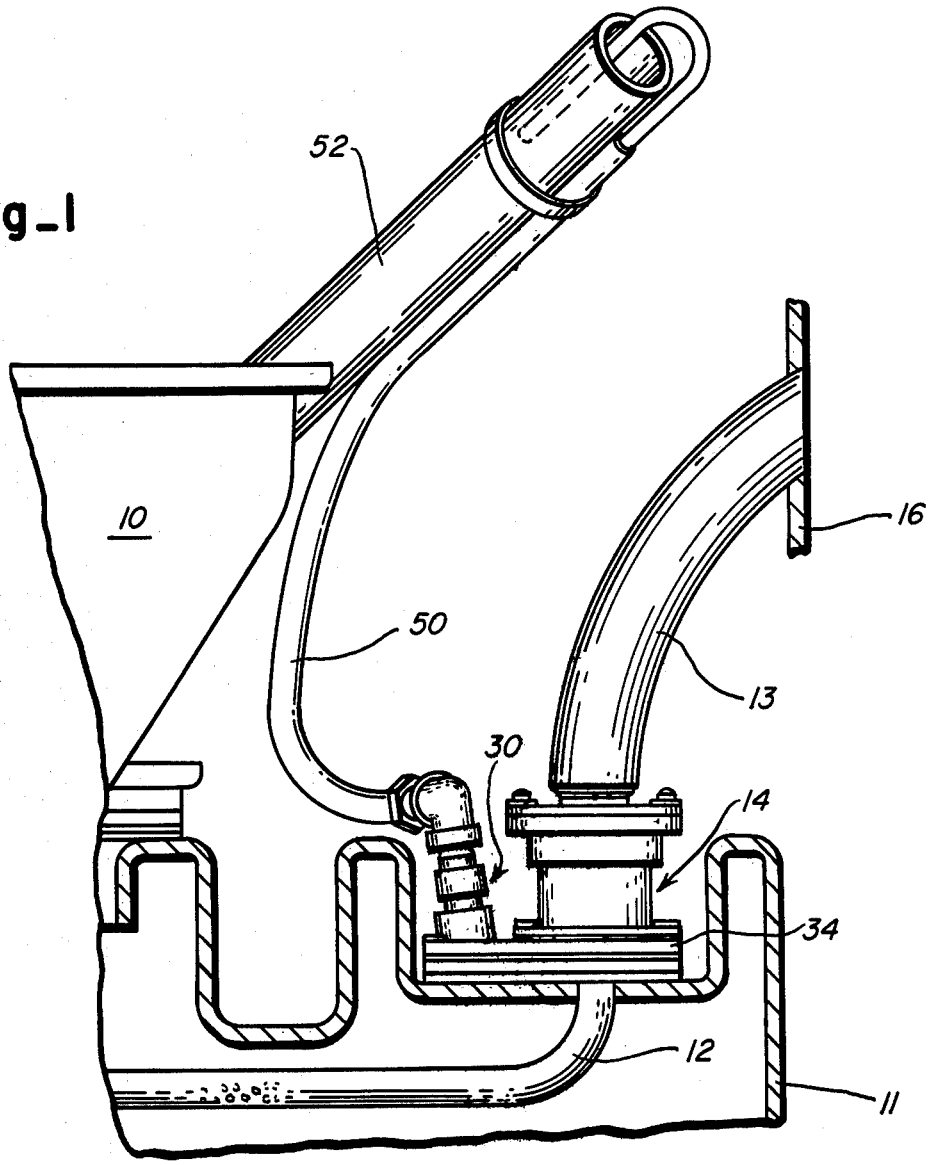

The present invention relates to self-contained toilet systems such as those utilized on airplanes.

In state of the art, self-contained toilets, as disclosed in detail in U.S. Pat. No. 3,501,778, the liquid portion of the contents of a toilet collecting tank is selectively recirculated as flushing medium to flush the toilet. Periodically, the collecting tank is drained and cleaned. To this end, a rinsing manifold may be located proximate the top of the collecting tank and periodically connected to a line of pressurized fluid such as potable water.

Since in an aircraft application the rinsing manifold communicates via a rinsing line to the skin of an airplane, a check valve is placed in the rinsing line to prevent the vacuum created in the rinsing line when the airplane is in flight from creating a leak in the airplane cabin through the rinsing manifold.

Such check valves are not totally effective at low pressure differentials, which exist during landing, and as a result, some of the contents of the collecting tank, which at such times normally has a high contents level and which is inclined in conformity with the landing angle of the airplane, is pulled through the rinsing manifold, check valve and rinsing line and discharged from the airplane. This is undesirable.

It is accordingly an object of the present invention to prevent the discharge of the contents of the collecting tank through the rinse line of an airplane.

Other objects and advantages of the present invention will become apparent from the following portion of this specification and from the accompanying drawings which illustrate in accordance with the mandate of the patent statutes a presently preferred embodiment incorporating the principles of the invention.

Figure 2:
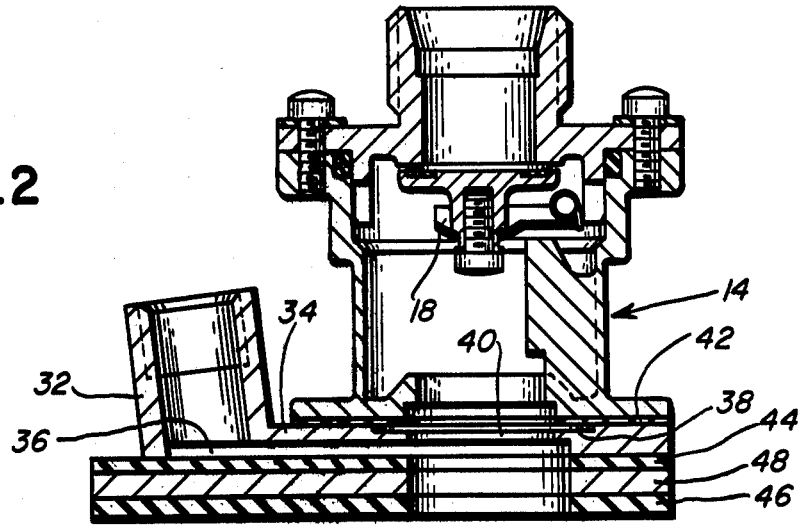

Referring to the drawings:

FIG. 1 is an elevational, partially broken away, view of a rinsing line assembly for a self-contained toilet assembly made in accordance with the teachings of the present invention; and FIG. 2 is an enlarged cross-sectional view of a portion of the rinsing line assembly illustrated in FIG. 1.

The self-contained toilet system includes a toilet bowl 10 and collecting tank 11. The collecting tank is periodically rinsed with potable water delivered to a rinsing line which includes a rinsing manifold 12, a rinsing conduit 13, and a check valve 14 joining the rinsing manifold and rinsing conduit. The rinsing conduit terminates at the skin 16 of an airplane. The pressure differential (approximately 8 PSIG), which normally exists across the check valve when the airplane is in flight, maintains the spring biased flapper mechanism 18 of the check valve in closed position. When rinsing fluid such as potable water is introduced under pressure into the rinsing conduit 13, the flapper is displaced to an open position permitting the rinsing fluid to pass into the rinsing manifold 12.

At low pressure differentials, which exist during landing, the check valve may not be completely effective and the contents of the collecting tank 11, which due to the incline of the airplane may engulf the rinsing manifold 12, may be forced, as a result of the pressure differential, through the rinsing manifold 12, check valve 14 and rinsing conduit 13 and discharged over the skin 16 of the airplane.

A ball-type check valve 30, which is normally open, is secured to the post element 32 of a mounting plate 34. The bore of the post element 32 communicates with a channel or slot 36 defined in the mounting plate 34, which with additional apertures 38, 40 in the mounting plate, and apertures in gaskets 42, 44, 46 and stud plate 48, establishes a flow path from both check valves to the rinsing manifold 12. The other end of the ball-type check valve 30 communicates with aircraft cabin pressure via an escape conduit 50, whereby the pressure tending to force fluid contained in the flushing manifold during landing through the check valve 14, will be effectively balanced by the same pressure entering the top of the flushing manifold from the ball-type check valve. The collecting tank contents will accordingly not be discharged from the aircraft through the rinse line.

When rinsing liquid is introduced into the rinsing conduit 13, this pressurized liquid closes the ball-type check valve 30. In the event that liquid leaks through this ball-type check valve, it will pass through the escape conduit 50 and a vent pipe 52 into the collecting tank 11.

What is claimed is:

1. A self-contained toilet comprising a collecting tank, means for rinsing the interior of said collecting tank including a rinsing manifold, a rinsing conduit, and a check valve operatively connecting said rinsing manifold and rinsing conduit, and means for preventing liquid contained within said rinsing manifold from being forced through said check valve by a pressure differential threracross including a normally open second check valve, and check valve conduit means communicating at one end with one end of said second check valve and communicating at the other end with said rinsing means at a location proximate the connection of said rinsing manifold and said first check valve, means for maintaining the second end of said second check valve and said collecting tank at the same pressure.

2. A self-contained toilet according to claim 1, wherein said means for maintaining comprises conduit means extending between the other end of said second check valve and the interior of said collecting tank.

* * * * *